United States Patent [19]

McCabe et al.

[11] Patent Number: 4,534,717

[45] Date of Patent: Aug. 13, 1985

[54] FLUSHABLE METERING PUMP

[75] Inventors: Bernard J. McCabe, Wyandotte; David T. Courtney, Livonia, both of Mich.

[73] Assignee: Ford Motor Company, Dearborn, Mich.

[21] Appl. No.: 601,110

[22] Filed: Apr. 18, 1984

Related U.S. Application Data

[63] Continuation of Ser. No. 260,221, May 1, 1981, abandoned.

[51] Int. Cl.[3] ..... F04C 2/18; F04C 13/00; B05B 15/02

[52] U.S. Cl. ..... 418/181; 418/206; 417/440

[58] Field of Search ..... 417/310, 440; 418/205, 418/206, 181; 239/112, 113

[56] References Cited

U.S. PATENT DOCUMENTS

| | | | |
|---|---|---|---|
| 1,943,491 | 1/1934 | Sieper | 418/206 |
| 2,636,440 | 4/1953 | Funk | 417/310 |
| 2,660,336 | 11/1953 | Coffey et al. | 417/440 |
| 3,023,706 | 3/1962 | De Fezzy et al. | 417/310 |
| 3,145,930 | 8/1964 | Herklotz et al. | 239/708 |
| 3,155,539 | 11/1964 | Juvinall | 118/698 |
| 3,219,273 | 11/1965 | Killen | 239/695 |
| 3,330,290 | 7/1967 | Porter | 137/99 |
| 3,403,695 | 10/1968 | Hopkins | 137/240 |
| 3,450,092 | 6/1969 | Kock | 118/703 |
| 3,458,133 | 7/1969 | Wiggins | 239/112 |
| 3,477,870 | 11/1969 | Boretti et al. | 427/424 |
| 3,672,570 | 6/1972 | Scarbrough et al. | 239/70 |
| 3,674,205 | 7/1972 | Kock | 239/1 |
| 3,857,513 | 12/1974 | Wiggins | 239/70 |
| 4,400,147 | 8/1983 | Springer et al. | 417/310 |

FOREIGN PATENT DOCUMENTS

| | | | |
|---|---|---|---|
| 885265 | 5/1943 | France | 417/440 |
| 1338281 | 8/1963 | France | 417/310 |

*Primary Examiner*—John J. Vrablik

*Attorney, Agent, or Firm*—Jerome R. Drouillard; Roger L. May

[57] ABSTRACT

A flushable, positive displacement, gear-type metering pump assembly comprising: a pump housing with inlet and outlet chambers; cylindrical gears disposed within the pump housing adapted to rotate such that gear faces mesh and form a seal which separates inlet and outlet chambers, the gears being adapted to carry metered amounts of fluid between the gear faces and the wall of the pump housing from the inlet chamber to the outlet chamber; channel means for conveying fluid into the inlet chamber and directing the fluid against the gear faces exposed to the inlet chamber; channel means for conveying fluid from the inlet chamber to valve means; channel means for conveying fluid from the valve means to the outlet chamber; valve means adapted to be closed when the pump assembly is in a metering mode such that fluid may pass from the inlet chamber to the outlet chamber only by being carried between the gear faces and the wall of the pump housing and in an open mode when the pump is in a flushing mode such that fluid may pass from the inlet chamber to the outlet chamber not only between the gear faces and the wall of the pump housing, but also through the channel valve means above; and channel means for conveying fluid from the outlet chamber and out of said metering pump assembly.

4 Claims, 13 Drawing Figures

FLUSHABLE METERING PUMP

This application is a continuation of application Ser. No. 260,221, filed May 1, 1981, now abandoned.

BACKGROUND OF THE INVENTION

This application relates to a flushable metering pump assembly. More particularly, this application relates to a flushable, metering pump assembly of the positive displacement, gear-type.

The positive displacement, gear-type metering pumps to which this invention relates are typically used to supply measured or metered amounts of fluid. They generally comprise gear means having two cylindrical gears disposed in a pump housing with the gears being adapted to rotate such that the gear faces intermesh and form a seal which separates inlet and outlet chambers of the pump. The gears are disposed in the pump housing such that metered amounts of fluid can be carried between the gear faces of the gears and the wall of the pump housing as the gears rotate, thus carrying the fluid from the inlet chamber of the pump to the outlet chamber of the pump. Such metering pumps are useful in those instances where materials must be delivered in measured amounts per unit time, and are particularly useful where two or more components must be delivered in measured amounts per unit time to prepare a composite material. In those cases, various feed lines delivering the various components may each flow through or be connected with a metering pump which meters the amount of fluid flowing through that line to the manifold or other means where the materials are combined.

One type of such system requiring metered amounts of two or more materials is a paint system employing multicomponent paint materials which must be combined just prior to application to a substrate. For example, two component paint systems based on polyurethanes which require one component containing a hydroxy functional resin and another component containing an isocycanate crosslinker must be combined just prior to application of the substrate because the components would react prematurely if combined earlier. The materials must be combined in precise amounts and therefore the two components must be metered as they pass to the spray gun where they are combined just prior to application to substrate.

In paint applications systems employing two component paints, such as those discussed above, a problem arises in connection with color changes which must frequently be made during painting operations, particularly those involving painting of automobiles. When a color is changed, it is necessary to flush the lines and the spray gun in order to avoid contamination of the color to be subsequently applied. In those cases where a metering pump is present in the common feed line for the component containing pigment, the metering pump must also be flushed. This flushing of a paint line, generally accomplished by high pressure introduction of gas and/or solvent, must be accomplished rapidly in order to accomplish a rapid color change. Unless the high pressure gas and/or solvent is allowed to at least partially bypass the metering pump, the speed of flushing is seriously impeded. Even in those instances where a multi-speed pump motor is employed so that the RPM of the pump may be increased so as to accommodate more rapid flow of solvent during the flushing cycle, the speed and thoroughness of the flushing are not adequate to allow rapid color change. The result is that in order to accomplish the degree of flushing of the pump and thereby avoid contamination of the paint, it is necessary to employ a greater flushing cycle period than is practical for assembly line operations. In addition, the operating life of a precision metering pump will be drastically shortened if it is operated at a high RPM with low lubricity flushing of solvents or solvent/gas mixtures during flushing.

U.S. Pat. No. 3,145,930 to Herklotz et al and 3,219,273 to Killen each disclose painting systems which are adapted to be flushed prior to changing colors. While neither of these painting systems employs multicomponent paints, they do include pumps which must be flushed prior to color change. In each case, however, the pumps are driven by multi-speed motors which, as discussed above, allow the RPM of the pump to be increased during the flush cycle thus increasing the amount of solvent that may pass therethrough. See Column 1, lines 46–62 and Column 2, lines 8–17 of Herklotz et al and Column 3, lines 50–74 of Killen. U.S. Pat. No. 3,330,290 to Porter teaches a water-fertilizer mixing pump which is adapted to be flushed so as to flush and wash out any fertilizer in the fertilizer portion of the pump. See drawing and Columns 2 and 3.

U.S. Pat. Nos.: 3,155,539 to Juvinall; 3,403,695 to Hopkins; 3,450,092 to Kock; 3,458,133 to Wiggins; 3,477,870 to Boretti et al; 3,672,570 to Scarbrough et al; 3,674,205 to Kock; and 3,857,513 to Wiggins all teach paint or coating systems providing for color change. However, none of these systems employs a pump which must be flushed during the change from one color to another and thus they do not address the above problem.

SUMMARY OF THE INVENTION

In accordance with the invention, a positive displacement, gear-type metering pump, is modified to make it rapidly flushable by incorporating into a pump of the type discussed above channel means for conveying fluid into the inlet chamber and directing the fluid against the gear faces exposed to the inlet chamber; channel means for conveying fluid from the inlet chamber to a valve means; channel means for conveying fluid from the valve means to the outlet chamber; and valve means adapted to be in open or closed modes. The valve means is adapted to be in a closed mode when the metering pump assembly is in a metering mode such that fluid may pass from the inlet chamber to the outlet chamber only when being carried between the gear faces and the wall of the pump housing as discussed above. The valve means is adapted to be in an open mode when the metering pump assembly is in a flushing mode such that the fluid may pass from the inlet chamber to the outlet chamber not only between the gear faces and the wall of the pump housing, but also through the channel means for conveying fluid from the inlet chamber to the valve means, the valve means, and the channel means for conveying fluid from the valve means to the outlet chamber.

By incorporating the valve means into the pump assembly so that flushing fluid may be flushed through the pump assembly more rapidly than can be accomplished by increasing the RPM of the pump, and by directing fluid through the channel means onto the gear faces which are exposed to both the inlet and the outlet chambers of the pump, it is possible to flush the metering pump substantially faster than would otherwise be possible.

The improved flushable, positive displacement, gear-type metering pump assembly of the invention will be more fully understood by reference to the following detailed description of the several preferred embodiments of the invention when read in conjunction with the drawings.

DESCRIPTION OF PREFERRED EMBODIMENTS OF THE INVENTION

The flushable, positive displacement, gear-type metering pump assembly of the invention comprises:

(A) a pump housing;

(B) inlet and outlet chambers within the pump housing;

(C) gear means comprising two cylindrical gears disposed within the pump housing, being adapted to rotate so the gear faces thereof mesh and form a seal separating the inlet and outlet chambers, the gear means being adapted to carry metered amounts of fluid between the gear faces and the wall of the pump housing from the inlet chamber to the outlet chamber as they rotate;

(D) means for driving the gear means;

(E) channel means for conveying fluid into the inlet chamber and directing the fluid against the gear faces exposed to the inlet chamber;

(F) channel means for conveying fluid from the inlet chamber to valve means;

(G) channel means for conveying fluid from the valve means to the outlet chamber;

(H) valve means adapted to be (i) in a closed mode when the metering pump assembly is in a metering mode such that the fluid can pass from the inlet chamber to the outlet chamber only by being carried between the gear faces and the wall of the pump housing as discussed above and (ii) in a open mode when the metering pump assembly is in a flushing mode such that the fluid can pass from the inlet chamber to the outlet chamber not only between the gear faces and the wall of the pump housing, but also through the channel means (F), the valve means, and channel means (G); and (I) channel means for conveying fluid from the outlet chamber and out of the metering pump assembly.

Preferred embodiments of the invention will now be discussed in conjunction with a detailed description of the drawings in which common parts thereof are indicated by the same numeral in each of the drawings.

Figure 1:
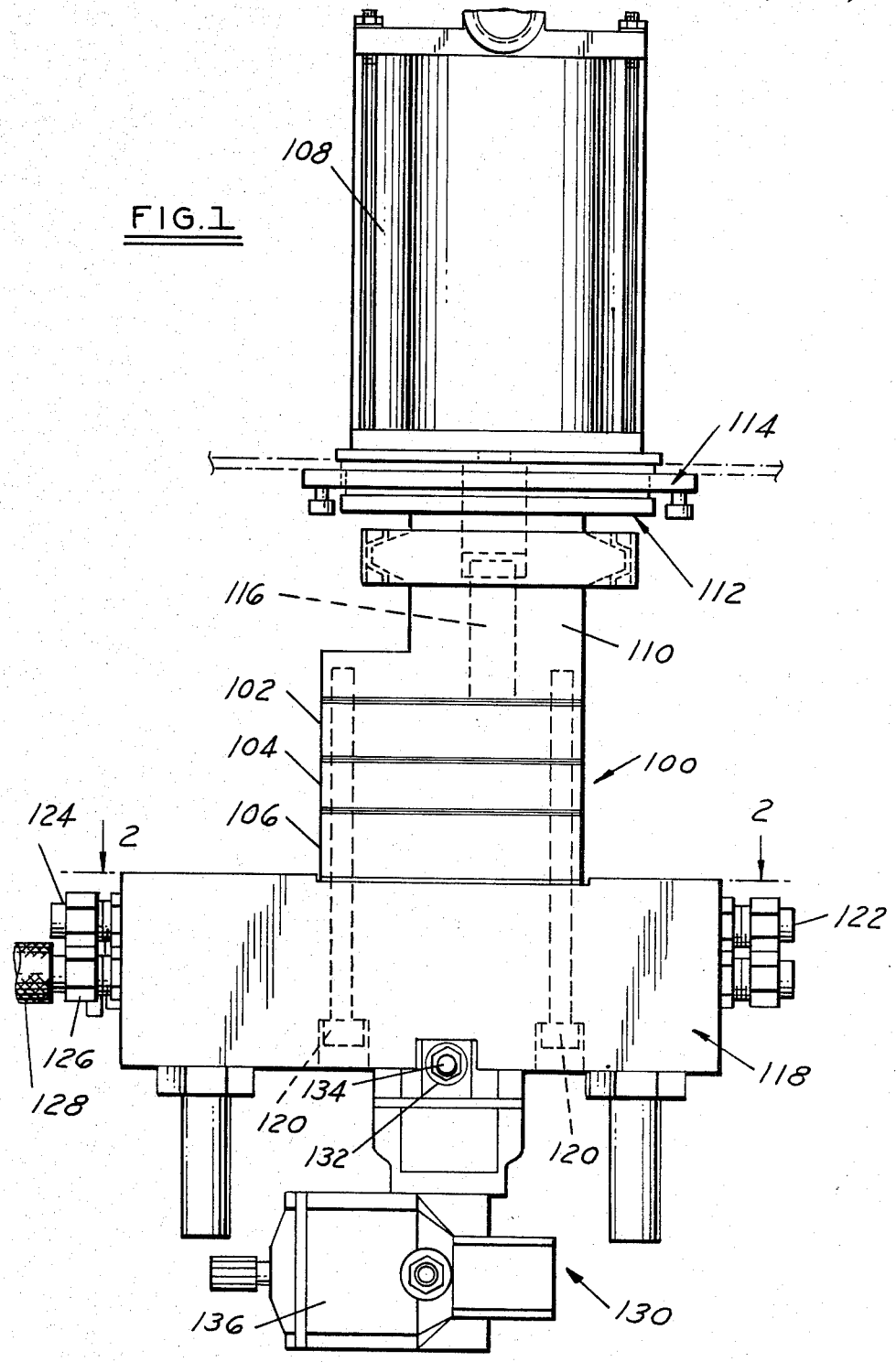
FIG. 1 is a perspective view of an embodiment of the flushable metering pump assembly of the invention.

FIGS. 1–7 all relate to a first preferred embodiment of the invention. Referring first to FIG. 1, which shows a perspective view of a flushable metering pump assembly in accordance with the invention, the assembly comprises a pump housing shown generally at 100 and consisting of plates 102, 104 and 106. Pump housing 100 is attached to a motor 108 by conventional means including pump mount 110, motor mounting 112 and clamping ring 114. Drive means 116 adapted to drive the gears of the gear means, not shown, is shown in dotted lines. Pump housing 100 is attached on the side next to plate 106 to manifold means 118 by bolts 120 which pass through the manifold means and the pump housing. The manifold is provided with manifold fittings 122 and 124 through which fluid passes in and out of the manifold. Fitting 126 is adapted to serve as a pressure relief line and is fitted accordingly with a pressure relief valve 128. Valve means generally shown at 130 is attached to the manifold means. Valve means comprises a ball valve 132, valve plug 134 and air actuator 136.

Figure 2:
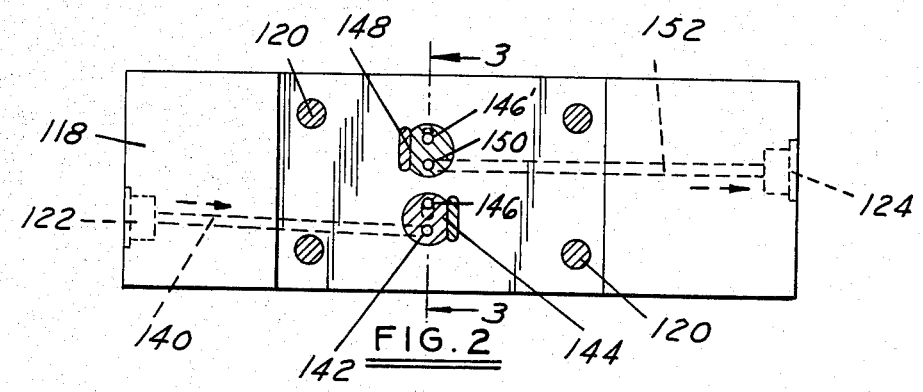
FIG. 2 is a sectional view of the manifold of the device of FIG. 1 taken along the line 2—2.

FIG. 2 is taken along line 2—2 of FIG. 1 and shows a top plan view of manifold 118. In operation of the flushable metering pump assembly of the device fluid enters through inlet fitting 122, the inner portion of which is shown in FIG. 2, and passes through inlet line 140 through the interior of the manifold to opening 142, this opening being located in the top of solvent probe 144. It is through this channel or passageway that the fluid is conveyed into the inlet chamber of the pump, which will be discussed hereinafter in greater detail. Opening 146 in the top of the solvent probe connects a channel or passageway passing through the probe from the inlet chamber to a channel or passageway which continues on through the manifold to the ball valve 132 shown in FIG. 1. Opening 146' in the top of solvent probe 148 connects a return channel or passageway coming from ball valve 132 with a channel or passageway passing through the probe and into the outlet chamber of the pump, to be discussed hereinafter in greater detail. Opening 150 in the top of probe 148 connects with the channel or passageway coming from the outlet chamber of the pump and, in turn, is connectd with channel or passageway 152 which conveys the fluid out of the manifold through fitting 124.

Figure 3:
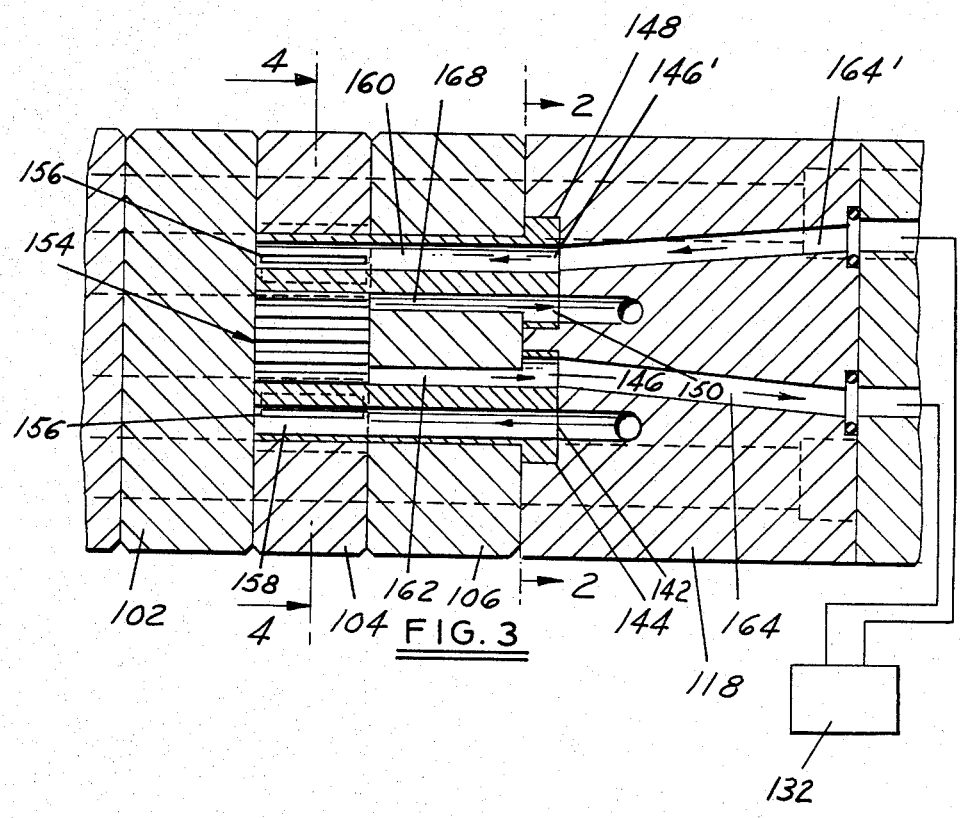
FIG. 3 is a cutaway view of the pump and manifold portions of the assembly of FIG. 1.

FIG. 3 shows a cutaway sectional view of the pump and manifold portion of flushable metering pump assembly in which pump housing 100 shown in FIG. 1 comprises plate 102 which is closest to the motor, central plate 104 containing the gear means shown at 154, and plate 106, closest to manifold 118. Inlet probes 144 and 148, having the heads thereof seated in manifold 118, extend through plate 106 and into center plate 104 through openings in the pump housing. Note that probes 144 and 148 are positioned such that at least a portion thereof extends along the length of the gear faces of gear means 154. The probe have openings or slits 156 along the length thereof which are exposed to the gear faces. The slits 156, shown as rectangular in shape, are in communication with passages 158 and 160 which pass through probes 144 and 148 respectively from openings 142 and 146' in the probe heads. In operation of the device fluid enters the manifold through fitting 122, passes through channel or passageway 140 and, opening 142 in the probe head of probe 144. The fluid passes through the probe in passageway 158 therein and then passes through rectangular slit 156 which is in communication with passageway 158. The fluid passing through slit 156 impinges upon the gear faces of gear means 154. Gear means 154 comprises two cylindrical gears in greater detail in FIG. 4. The gears are rotating such that the gear faces intermesh and form a seal between the inlet chamber in which the inlet probe 144 is inserted and the outlet chamber in which outlet probe 148 is inserted. When the pump is in a metering mode the fluid is carried between the gear faces and the wall of the pump housing as the gears rotate, the fluid being carried from the inlet chamber to the outlet chamber of the pump. When the pump is in a flushing mode and ball valve 132 is open, fluid may pass up through channel 162 in inlet probe 144 through opening 146 in the probe head and then pass through channel or passageway 164 passing through manifold 118 to ball valve 132. When in a flushing mode ball valve 132 is open such that fluid may pass therethrough and return via return line 164' through opening 146' in the head of probe 148. The fluid then passes through channel 160 and still further passes through rectangular slit 156. The fluid passing therethrough is directed in a rectangular stream against the gear faces of gear means 154. Fluid, whether material being metered or that being metered and flushed, then passes through channel 168 in probe 148 through opening 150 in the head of probe 148 and then out through outlet line 152 to outlet fitting 124 and out of the manifold.

Figure 4:
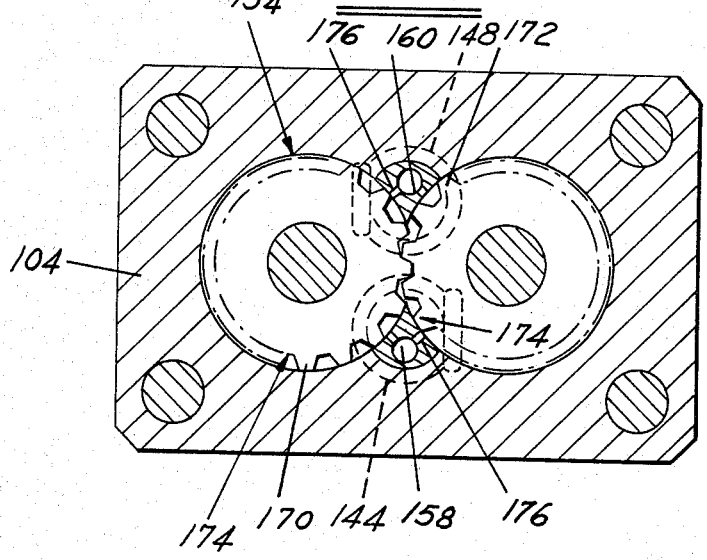
FIG. 4 is a sectional view taken along line 4—4 of FIG. 3 showing the intermeshing gears of the metering pump of the assembly.

FIG. 4 is a sectional view taken through plate 104 along line 4—4 of FIG. 3. Gear means 154 is shown as consisting of cylindrical gears 170 and 172, each having gear faces or gear teeth 174 thereon. As can be seen, gear faces 174 intermesh to form a seal separating the inlet chamber area and the outlet chamber area of the pump. The outlines of the tops of inlet and outlet probes 144 and 148 respectively are shown in dotted lines. Inlet probe 144 is inserted into the inlet chamber of the pump with fluid passing through channel 158 and through channels 176 which connect the inlet line 158 in the probe with slits 156 (FIG. 3). Fluid passing therethrough is directed out through slits 156 directly at the gear faces in a radial direction relative to the gears 170 and 172. Probe 148 is positioned in the outlet chamber area of the pump. Fluid returning from ball valve 132 of the device, when in the flushing mode, passes through channel 160 through channels 176 connected therewith and out through slits 156. As was the case with inlet probe 144, fluid passing through slits 156 is directed in a radial direction relative to the gears against gear faces 174.

Figure 5:
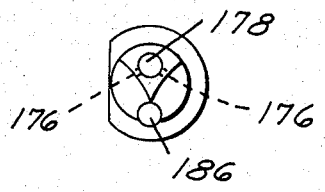
FIGS. 5 shows a cutaway end view of the solvent probes used in the embodiment of FIG. 1.
Figure 6:
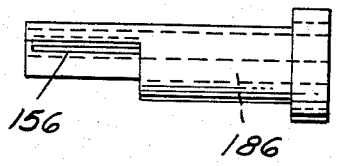
FIGS. 6 and 7 show perspective views of the solvent probe.
Figure 7:
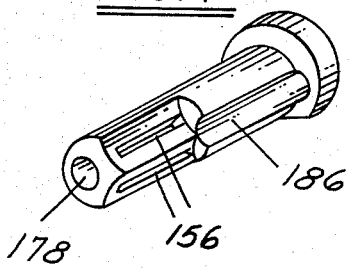

FIGS. 5, 6 and 7 show various views of probes 144 and 148. FIG. 7 is a perspective view of a probe. Inlet and outlet probes in the device are identical. Hole 178 is a continuation of channels 158 and 160 which carry fluid into the probe. This hole or the end of this passageway is closed off when the probe is inserted into the pump housing, since the bottom of the probe bottoms out against plate 102. (Of course the hole need not be present since it serves no purpose other than for machining. Thus, fluid passing through passages 158 and 160 must pass out through slits 156. Groove 186 serves as return channel 162 and 168 for fluid leaving the inlet or outlet chamber of the device and passing back to manifold 118. FIG. 5 shows the end view of the probe showing hole 178 and channels 176 which run from channels 158 and 160. Slits 156 are also shown in FIG. 6 and the inlet and outlet passageways in and out of the probe are shown in dotted lines.

Figure 10:
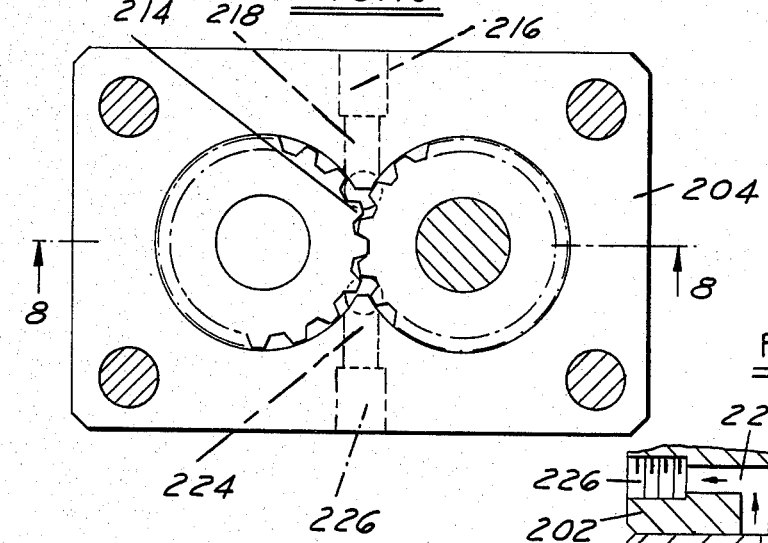
FIG. 10 is a sectional view of the embodiment of FIG. 8 taken along line 10—10.
Figure 9:
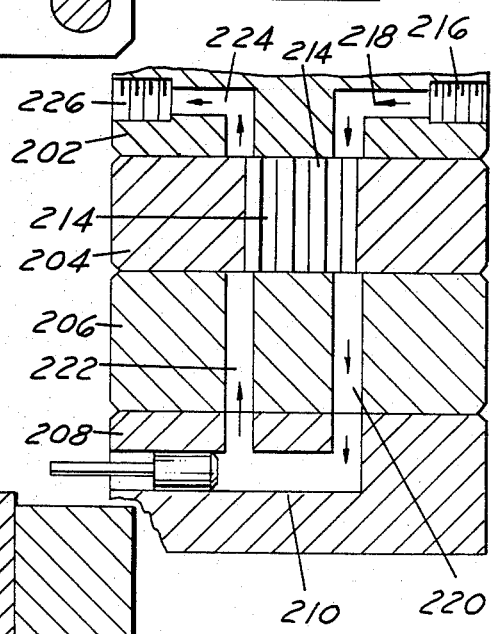
FIG. 9 is a sectional view of the embodiment of FIG. 8 taken along line 9—9.
Figure 8:
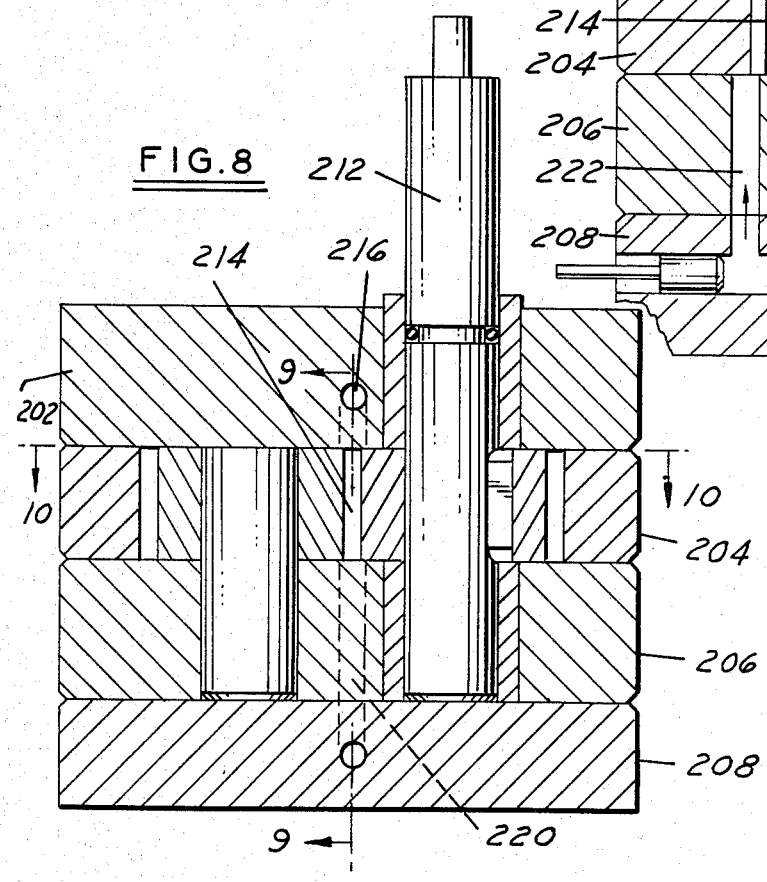
FIG. 8 shows another embodiment of the flushable metering pump assembly of the invention.

FIGS. 8, 9 and 10 show another preferred embodiment of the invention. In accordance with this embodiment of the invention, the valve means is located within the pump housing. The pump housing comprises plates 202, 204, 206 and 208. Bypass valve 210 is located in plate 208 which is essentially an extra plate which has been added to a conventional metering pump assembly having three plates. Drive shaft 212 turns the gear means so that gear faces intermesh at 214. In operation of this embodiment fluid passes into the pump housing through a channel which passes through and is bounded laterally by plate 202 from opening 216. As shown in FIG. 9 the fluid passes through channel 218 which turns in plate 202 and directs the fluid along gear face 214 in the inlet chamber area in a direction substantially parallel to the axes of the gears. The fluid enters from channel 218 at the end of the axes of the gears so that the fluid passes along the gear faces substantially along the entire length of the gear face 214. The fluid then passes from the inlet chamber through line 220 to bypass valve 210 in plate 208. When the valve is in the open mode as shown in FIG. 9, the fluid is free to move through return line 222 which passes through plate 206 and introduces the fluid in a direction substantially parallel to the axes of the gears in the outlet chamber at the end of the axes so that the fluid passes substantially along the entire length of gear face 214 prior to passing out through channel 224 which then passes out through outlet 226 in the side of plate 202 opposite inlet opening 216. FIG. 10 is taken along line 10—10 of FIG. 8 and shows the inlet line 218 and return line 224 and their orientation relative to the gear faces of the assembly.

Figure 12:
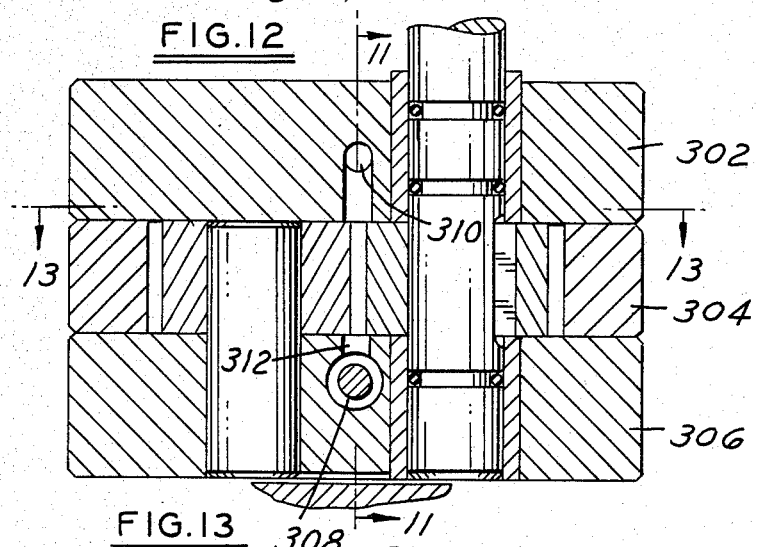
FIG. 12 is a section of the embodiment shown in FIG. 11 taken along line 12—12 thereof.
Figure 13:
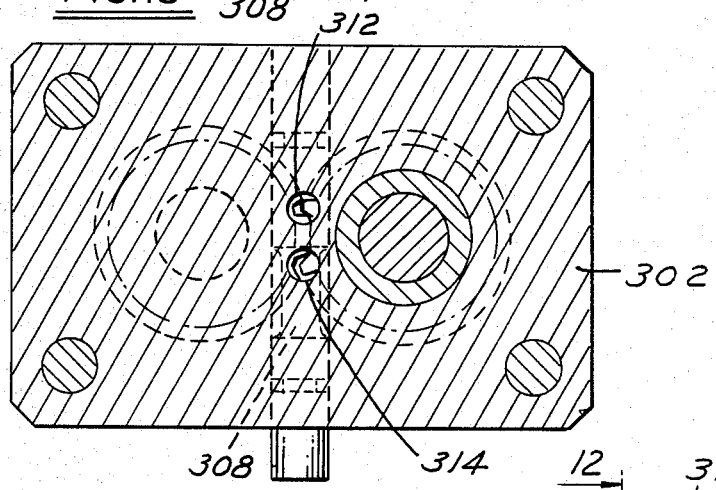
FIG. 13 is still another sectional view of the device of FIGS. 11 and 12 taken along line 13—13 thereof.
Figure 11:
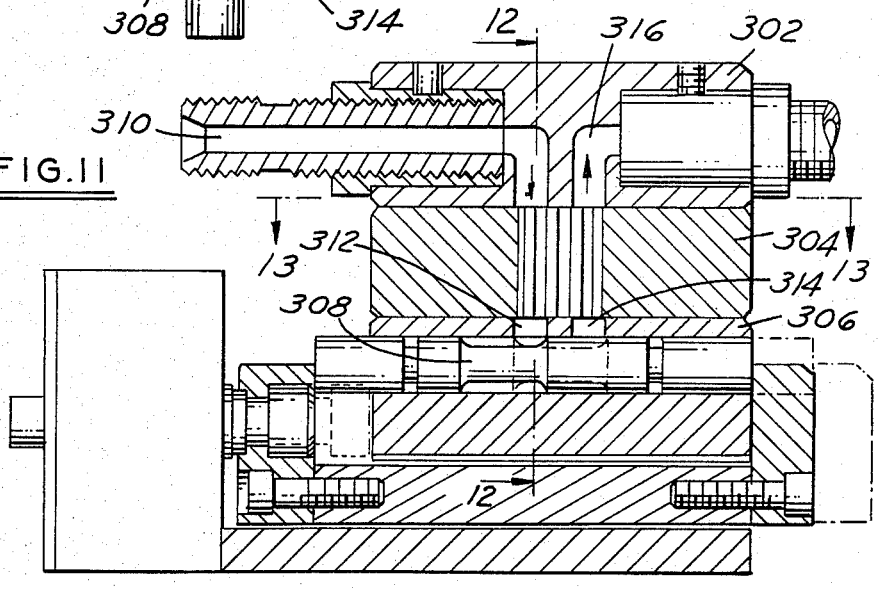
FIG. 11 is a plan sectional view of still another embodiment of the flushable metering pump assembly of the invention.

FIGS. 11, 12 and 13 show still another preferred embodiment of the invention. In this embodiment the valve means is included within the pump housing. In this case, however, the pump housing comprises only three plates 302, 304 and 306. In this embodiment the valve means, which consists of a moveable valve spool 308 is positioned in plate 306, valve spool 308 is shown in solid lines in a closed mode and in dotted lines in an open mode. In operation of the device of this embodiment fluid enters through channel 310 in plate 302 and enters the inlet chamber of the device where it passes in a substantially parallel fashion along the gear faces while in plate 304 and then out of the inlet chamber into plate 306 while in the open or by-pass mode. When the valve is closed as shown in solid lines the fluid must pass by metering between gear faces and the wall of the pump housing plate 304 into the outlet chamber. When valve spool 308 is in the dotted or open position the fluid may flow into plate 306 through opening 312 and back up into plate 304 and toward the gear faces in a substantially parallel manner through opening 314. After passing past the gear faces along the axes of the gears, the fluid material then passes out through channel 316 and out of plate 302 on the side opposite the inlet. FIG. 12 is a sectional view of this embodiment taken along line 12—12 of FIG. 11. FIG. 13 is a sectional view of this embodiment of the device taken along line 13—13 of FIG. 11. This sectional view shows the gears and interfacing gear faces and, in dotted lines, shows the valve spool 308 located in plate 306 behind the gears.

It will be appreciated that the flushable metering pump assembly embodiments shown in the drawings and the discussion thereof are presented merely by way of example and are not intended to be limiting. It will be apparent to those skilled in the art that various other embodiments of the flushable metering pump assembly may be constructed within the scope of the invention as defined by the appended claims.

What is claimed:

1. A flushable, positive displacement, gear-type metering pump assembly comprising;

(A) a pump housing;

(B) inlet and outlet chambers within said pump housing;

(C) gear means comprising two cylindrical gears disposed within said pump housing, being rotatable such that gear faces thereof mesh and form a seal which separates said inlet and outlet chambers, and being capable of carrying metered amounts of fluid between said gear faces and the wall of said pump housing from said inlet chamber to said outlet chamber;

(D) means for driving said gear means:

(E) channel means for conveying fluid into said inlet chamber and directing said fluid against said gear faces exposed to said inlet chamber;

(F) channel means for conveying fluid from said inlet chamber to valve means;

(G) channel means for conveying fluid from said valve means to said outlet chamber, said channel means being disposed such that fluid passing therethrough into said outlet chamber is directed against said gear faces in a direction substantially parallel to the axes of said gears from a location substantially near one end of said axes;

(H) valve means which may be (i) in a closed mode when said metering pump assembly is in a metering mode such that fluid may pass from said inlet chamber to said outlet chamber only by being carried between said gear faces and said wall of said pump housing and (ii) in an open mode when said metering pump assembly is in a flushing mode such that pressurized fluid may pass from said inlet chamber to said outlet chamber not only between said gear faces and said wall of said pump housing, but also through said channel means (F), said valve means, and channel means (G); and (I) channel means for conveying fluid from said outlet chamber and out of said metering pump assembly, all of said channel means (E), (F), (G) and (I) at the ends of said gear faces being sustantially parallel to the axes of said gears.

2. A metering pump assembly in accordance with claim 1, wherein said valve means is located within said pump housing.

3. A flushable, positive displacement, gear-type metering pump assembly comprising:

(A) a pump housing;

(B) inlet and outlet chambers within said pump housing;

(C) gear means comprising two cylindrical gears disposed within said pump housing, being rotatable such that gear faces thereof mesh and form a seal which separates said inlet and outlet chambers, and being capable of carrying metered amounts of fluid between said gear faces and the wall of said pump housing from said inlet chamber to said outlet chamber;

(D) means for driving said gear means;

(E) channel means for conveying fluid into said inlet chamber, said channel means being disposed such that substantially all fluid passing therethrough is directed against said gear faces exposed to said inlet chamber in a direction substantially parallel to the axes of said gears from a location substantially near one end of said axes;

(F) channel means for conveying fluid from said inlet chamber to valve means, said chamber means being located at the end of the axes of said gears opposite said end where said fluid is introduced from said channel means (E) such that fluid which passes along said gear faces in a direction substantially parallel to the axes after being introduced into said inlet chamber by channel means (E) flows towards said channel means (F);

(G) channel means for conveying fluid from said valve means to said outlet chamber said channel means being disposed such that fluid passing therethrough into said outlet chamber is directed against said gear faces in a direction substantially parallel to the axes of said gears from a location substantially near one end of said axes;

(H) valve means which may be (i) in a closed mode when said metering pump assembly is in a metering mode such that fluid may pass from said inlet chamber to said outlet chamber only by being carried between said gear faces and said wall of said pump housing and (ii) in an open mode when said metering pump assembly is in a flushing mode such that pressurized fluid may pass from said inlet chamber to said outlet chamber not only between said gear faces and said wall of said pump housing, but also through said channel means (F), said valve means, and channel means (G); and (I) channel means for conveying fluid from said outlet chamber and out of said metering pump assembly, all of said channel means (E), (F), (G) and (I) at the ends of said gear faces being substantially parallel to the axes of said gears.

4. A metering pump assembly in accordance with claim 3, wherein said valve means is located within said pump housing.

* * * * *